US006598394B2

(12) United States Patent
Shimokakiuchi et al.

(10) Patent No.: US 6,598,394 B2
(45) Date of Patent: Jul. 29, 2003

(54) CONTROL CIRCUIT FOR CONSTRUCTION MACHINE

(75) Inventors: Hiroshi Shimokakiuchi, Hiroshima (JP); Hisashi Kadowaki, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 11 days.

(21) Appl. No.: 10/055,927

(22) Filed: Jan. 28, 2002

(65) Prior Publication Data

US 2002/0116921 A1 Aug. 29, 2002

(30) Foreign Application Priority Data

Feb. 23, 2001 (JP) ..... 2001-048962

(51) Int. Cl.[7] ..... E02F 9/20
(52) U.S. Cl. ..... 60/399; 60/427; 60/484
(58) Field of Search ..... 60/399, 427, 484, 60/483, 425

(56) References Cited

U.S. PATENT DOCUMENTS 5,125,232 A 6/1992 Arii et al. ..... 60/484

FOREIGN PATENT DOCUMENTS

| | | | |
|---|---|---|---|
| EP | 0 712 062 | 5/1996 | |
| EP | 0 783 057 | 7/1997 | |
| EP | 0 849 406 | 6/1998 | |
| JP | 56-121752 | 9/1981 | |
| JP | 62-44956 | 3/1987 | |
| JP | 2-89051 | 7/1990 | |
| JP | 6-65941 | 3/1994 | |
| JP | 08013548 A * | 1/1996 | ..... E02F/9/24 |

* cited by examiner

*Primary Examiner*—Edward K. Look
*Assistant Examiner*—Thomas E. Lazo
(74) *Attorney, Agent, or Firm*—Oblon, Spivak, McClelland, Maier & Neustadt, P.C.

(57) ABSTRACT

A control circuit for a construction machine using a control lever for revolving a boom swing in common with a traveling motor and switching pilot pressure via a switching valve has a switch for supplying a switching signal to the switching valve. A pressure switch detects whether the pilot pressure is output from a remote control valve or not. A switching control circuit switches a position of the switching valve to a position for the boom swing cylinder when the switching signal is output from the switch and holds the position of the switch at the position for the boom swing cylinder when the pilot pressure is detected by the pressure switch, to thereby prevent wrong operation in switching.

4 Claims, 3 Drawing Sheets

CONTROL CIRCUIT FOR CONSTRUCTION MACHINE

BACKGROUND OF THE INVENTION

1. Field of the Invention

The present invention relates to a control circuit for a construction machine for switching a plurality of actuators.

2. Description of the Related Art

Conventionally, a hydraulicexcavator equipped with a boom swing apparatus is known, for excavating a small place at the corner by swinging a boom left and right around a vertical axis. As an operating means for operating a boom swing cylinder, there is an operating means in which a foot pedal is used. Such an equipment with the foot pedal limits space in foot side. Also, equipment with a nibbler or a breaker as an option increases the number of pedals and makes operations thereof complex.

For this reason, an operation lever can be used, which performs together operation of the boom swing cylinder and operation of an actuator, for example a revolving motor that is not operated in combination of boom swing.

In this case, when after switching from revolving to boom swing, if the switching operation is not recognized, there is a problem that mis-operation can occur that the revolving is derived from the operation carried out for a boom swing purpose.

SUMMARY OF THE INVENTION

An object of the present invention is to provide a control circuit for a construction machine capable of certainly preventing wrong operation in a case that a plurality of actuators are operated by means of only one control lever.

The control circuit for a construction machine according to the present invention has following constitution.

The present invention comprises: a control lever for carrying out operations of a first actuator and a second actuator in common; a switching valve or a selector valve for supplying pilot pressure output from a remote control valve by means of operation of the control lever to a control port in any one of the first and the second actuators; a control member for supplying a switching signal to the switching valve; a detector for detecting whether the pilot pressure is output from the remote control valve or not; and a switching controller for switching a change-over position in the switching valve from the first actuator to the second actuator when the switching signal is output from the control member and holding the position at the second actuator when output of the pilot pressure is detected by the detector.

According to the present invention, if the control member is operated, the switching valve switches a pilot pressure supply place to which the pilot pressure is output from the remote control valve of the control lever, from the first actuator to the second actuator, and then the detector detects the pilot pressure if the pilot pressure appears in a pilot line by means of operation of the control lever. The switching control means holds the switching valve at the second actuator when the switching signal is output from the control member and when output of the pilot pressure is detected by the detector. Thereby, switching from the first actuator to the second actuator does not occur as long as the control member is not operated. Also, when the control lever is operated in a state that the control member is operated to switch the position of switch to the second actuator, the position cannot be switched to the first actuator even if the control member is off, as long as the control lever is not restored in neutral position. Therefore, wrong operation can be prevented in switching. Also, even if a finger is taken off the control member during operation, a bad situation that the position of switch is switched to other actuator can be prevented.

DESCRIPTION OF THE PREFERRED EMBODIMENTS

Figure 1:
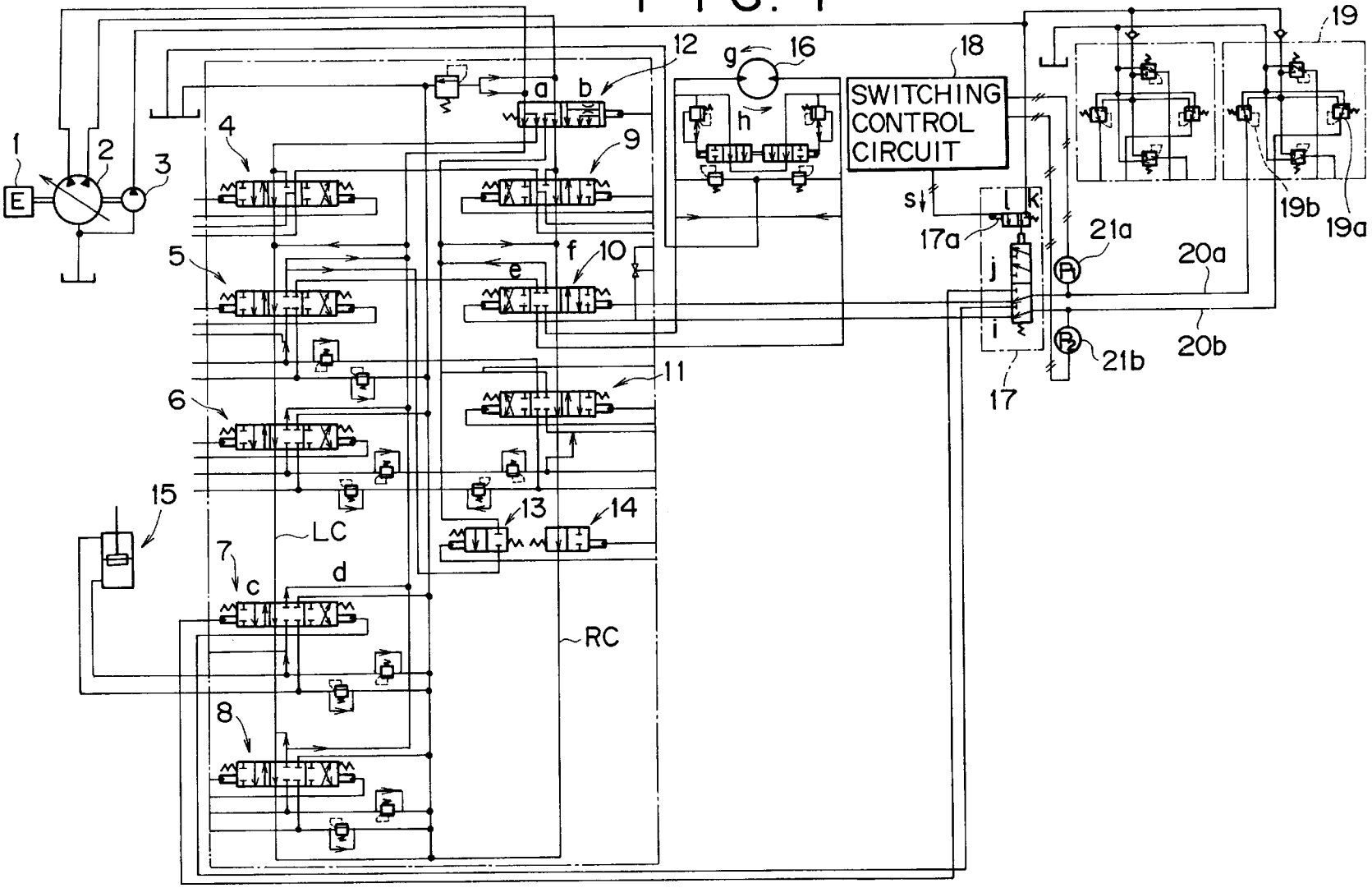
FIG. 1 is a diagram showing a control circuit for a construction machine according to one embodiment of the present invention.

Now, the present invention will be explained on the basis of embodiments shown in the drawings. These embodiments are only preferred embodiments of the present invention and the present invention is not limited to them.

FIG. 1 shows one embodiment of a control circuit for a construction machine according to the present invention.

In FIG. 1, a variable capacity type of hydraulic pump 2 and a pilot pump 3 are operated, respectively, by means of driving of an engine 1 equipped in an upper rotating body of the construction machine.

Hydraulic oil discharged from the hydraulic pump 2 is supplied to a right traveling control valve 4, a boom control valve 5, a bucket control valve 6, a boom swing control valve 7 and a control valve 8 for a crusher/breaker as an option apparatus, arranged in a center bypass line LC on the left of FIG. 1. The hydraulic oil is also supplied to a left traveling control valve 9, a revolving control valve 10 and an arm control valve 11, arranged in a center bypass line RC on the right of FIG. 1. The hydraulic oil discharged from the pilot pump 3 is used as a pressure source for various controllers.

A straight traveling valve 12 provided upstream in the traveling control valve 4, 9 has positions of switch comprised of a, b and is normally held at the position a.

At the position a, the hydraulic oil from the hydraulic pump 2 is independently supplied to the left center bypass line LC and the right center bypass line RC. If, in a state that the right and left traveling levers are operated to the same position, for example the boom or the arm is operated, then the straight traveling valve 12 is switched from the position a to the position b. Accordingly, the hydraulic oil from the hydraulic pump 2 flows in parallel to the left center bypass line LC and the right center bypass line RC. At that time, even if a combined operation is carried out such that the boom is risen and fallen while a traveling motor 16 is driven, the hydraulic oil from the hydraulic pump 2 is supplied equally to the left and the right traveling motors. By means of this, the straight traveling can be kept. Also, in the drawing, 13 is a conflux valve for increasing the boom-up speed and 14 is a cut valve for making the hydraulic oil flow in the left center bypass line LC.

Figure 4:
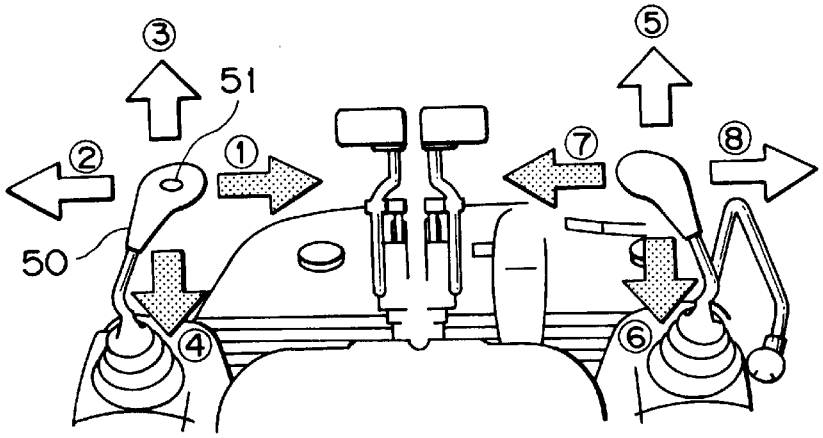
FIG. 4 is a schematic view showing operations of a control lever.

Next, switching operation of the control lever will be explained with reference to FIG. 4. As shown in FIG. 4, by operating a switch 51 provided at upper grip part of a left control lever sq, revolving of an upper rotating body and boom swing are switched. That is, by means of revolving operation, the operation in ① direction becomes right revolving and the operation in ② direction becomes left revolving. When the switch 51 is pushed, the operation in ① direction makes boom right swing and the operation in ② direction makes boom left swing. For reference, operations of lever for arm releasing and excavating, boom rising and falling, or bucket excavating and releasing are exemplified in FIG. 4. That is, in the left control lever, ① indicates right revolving, ② indicates left revolving, ③ indicates arm releasing and ④ indicates arm excavating. Also, in the right control lever, ⑤ indicates boom falling, ⑥ indicates boom rising, ⑦ indicates bucket excavating and ⑧ indicates bucket releasing.

Also, in a case that the switch 51 is a toggle switch, a tumbler switch or the like, the switch is fixed to either the boom swing or the revolving whenever the switch 51 is operated. Also, in a case that the switch 51 is an automatic restoring type of push button switch, it is switched to the boom swing only when pushed with fingers. Here, the present invention is not limited to the switching mode of the control lever as described above.

Now, a switching operational circuit of the revolving motor (as first actuator) and the boom swing cylinder (as second actuator) related to the present invention will be explained. Explanation for operation of actuators except for them will be omitted for simplification.

Figure 2A:
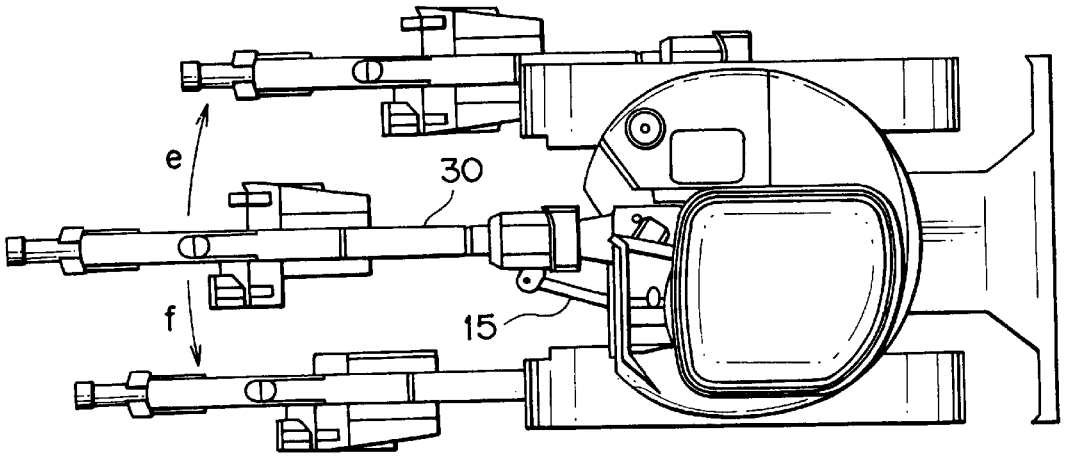
FIG. 2*a* is a plan view of the construction machine for explaining boom swing operation and FIG. 2*b* is a side view thereof.
Figure 2B:
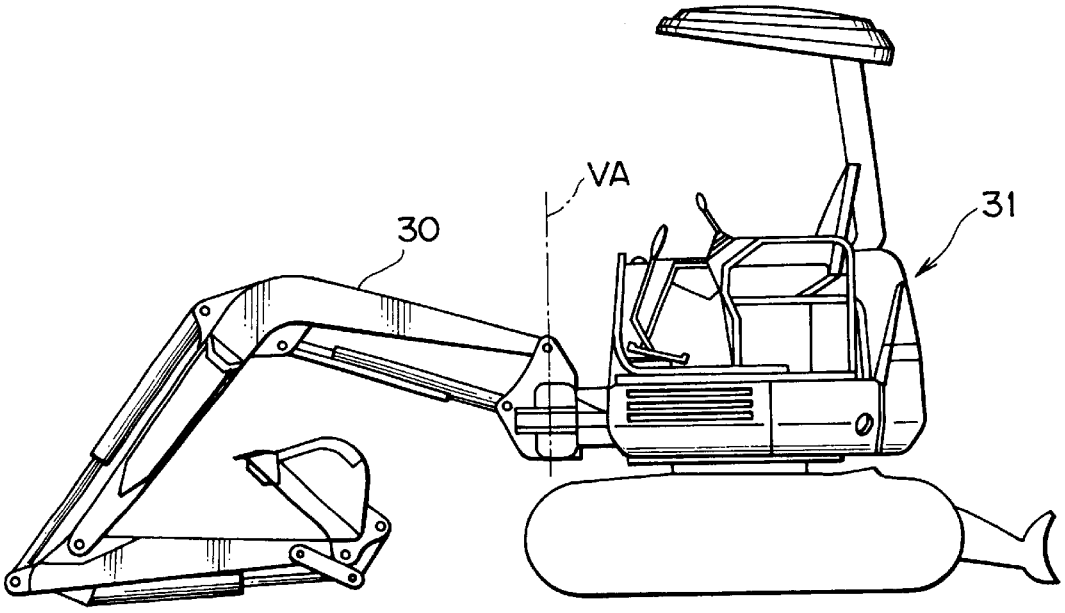

The boom swing cylinder 15 is connected to the boom control valve 7. If the control valve is switched from the neutral position to the position c, the hydraulic oil is supplied to a head side of the boom swing cylinder 15. At that time, as shown in FIGS. 2*a* and 2*b*, the boom 30 can be swung, for example, right (e direction in the drawing) around the vertical axis VA. If the control valve is switched to the position d, the hydraulic oil is supplied to rod side of the boom swing cylinder 15. At that time, the boom 30 can be swung left (f direction in the drawing) around the vertical axis VA.

The revolving motor 16 is connected to the revolving control valve 10. If switched from the neutral position to the position e, the revolving motor 16 is rotated in g direction to rotate the upper rotating body 31 (see FIG. 2*b*), for example, right. Also, if switched to the position f, the upper rotating body can be rotated left.

The pilot line of the boom control valve 7 and the pilot line of the revolving control valve 10 are connected to the outlet port of the switching valve 17, respectively.

This switching valve 17 is normally positioned at the position i, and is connected to the control port of the revolving control valve 10. If switching signals is received from the switching control circuit 18 as a switching controller, the switching valve 17 is switched to the position j by means of hydraulic signal sent via the electromagnetic valve 17*a*. Accordingly, the pilot pressure is supplied to the control port of the boom swing cylinder 15.

The inlet port of the switching valve 17 is connected to the remote control valve 19 of the left control lever 50 (see FIG. 4). If the left control lever 50 is shifted in ① direction, the pilot pressure is derived from the remote control valve 19*a*. Also, if the lever is shifted in ② direction, the pilot pressure is derived from the remote control valve 19*b*. These pilot pressures flow through the respective pilot lines 20*a* and 20*b* to the inlet port of the switching valve 17.

These pilot lines 20*a* and 20*b* are provided with pressure switches 21*a* and 21*b* as detector, respectively. If any one of the pilot lines 20*a* and 20*b* detects the pilot pressure, the signal is output to the switching control circuit 18.

Therefore, in the present invention, the detector is comprised of pressure switches provided in the pilot lines passing from the remote control valve to the switching valve. In this case, because the detector is constructed with the conventional pressure switch for detecting operational pressure from the remote control valve, the control circuit of the present invention can be embodied without new sensor required.

Figure 3:
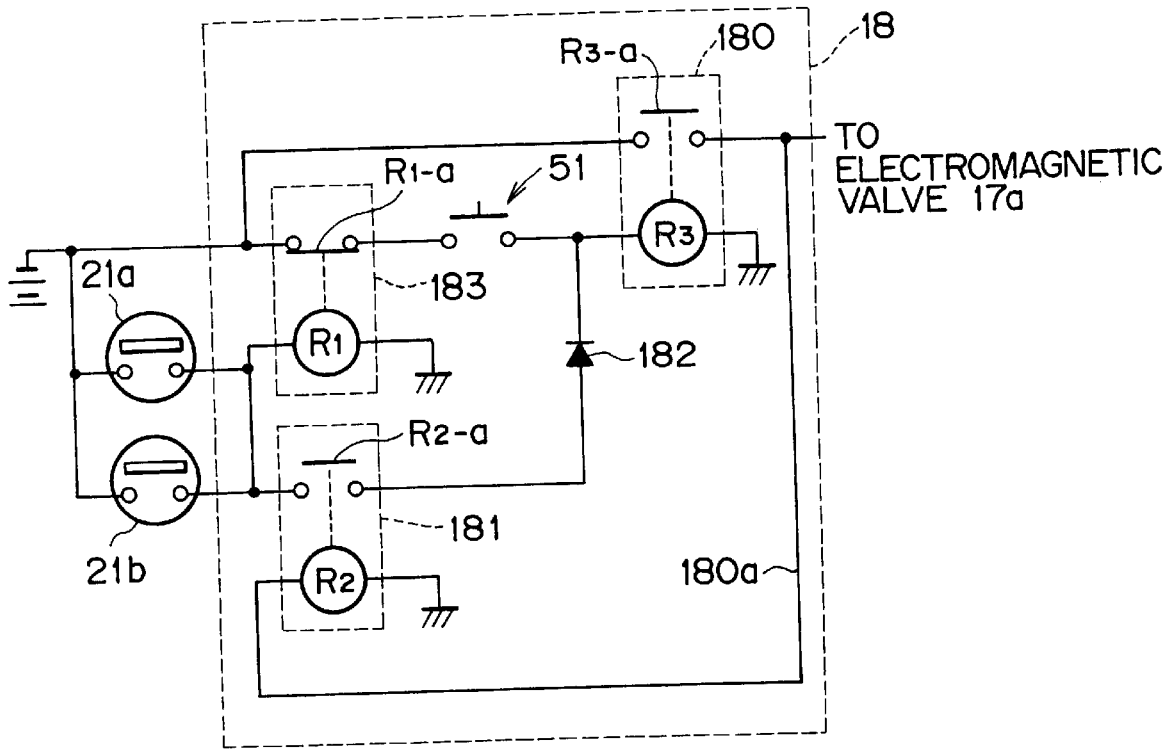
FIG. 3 is a circuit diagram showing constitution of a switching control circuit shown in FIG. 1.

Next, construction of the switching control circuit 18 will be explained with reference to FIG. 3.

First, if the push-button switch (control member) 51 provided in grip of the left control lever 50 is pushed, an electromagnetic coil $R_3$ of the relay 180 is excited. As a result, the contact point $R_{3\text{-}a}$ is closed. Thereby, the solenoid of the electromagnetic valve 17*a* is turned on and the electromagnetic valve 17*a* is switched from the intercepting position k to turn-on position or conducting position 1.

If the hydraulic signal is applied to the control port of the switching valve 17 via the electromagnetic valve 17*a*, the switching valve 17 is switched to the position j. As a result, the pilot lines 20*a* and 20*b* are connected to the control port of the boom swing control valve 7. Accordingly, ① and ② operations by the left control lever 50 function as the boom swing operations.

If the contact point $R_{3\text{-}a}$ is closed, current flows through the signal line 180*a* to the relay 181. As a result, the electromagnetic coil $R_2$ is excited and the contact point $R_{2\text{-}a}$ is closed. In this state, if the left control lever 50 is shifted in any of ① direction and ② direction, the pressure switch 21*a* or 21*b* is closed to turn on electricity and to make current flow. This current flows via the contact point $R_{2\text{-}a}$ and diode 182 to the electromagnetic coil $R_3$. As a result, the relay 180 is self-held. That is, even when fingers are taken off the switch 51, the switching valve 17 is held at the position j. Accordingly, the boom swing operation is continued.

Also, if the revolving operation is carried out when the switch 51 is not pushed, the electromagnetic coil $R_1$ of the relay 183 is excited to open the contact point $R_{1\text{-}a}$. As a result, even when the switch 51 is pushed, the relay 180 and 181 do not function and the switching valve 17 is never switched to the boom swing control valve 7. That is, when the switch 51 is not pushed, the operation mode is always fixed to the revolving operation. Only when the switch 51 is pushed, the operation mode is switched to the boom swing operation.

In the present invention, a relay is provided between the control member and the switching valve, the relay being constructed to be self-held with signal output from the detector. In this case, the control circuit of the present invention can be embodied with a simple construction such that a relay circuit is added.

As described above, in the control circuit of the present embodiment, the operation mode is not switched to the boom swing operation as long as the switch 51 is not pushed. Moreover, after the operation mode is switched to the boom swing operation, the boom swing operation is continued as long as the left control lever 50 is not restored to the neutral position. As a result, the revolving operation and the boom swing operation can be switched surely and safely. Also, even when fingers are taken off the switch 51 during the boom swing operation, the operation mode is never switched to the revolving operation.

Moreover, although the relay is used to control in sequence in the above embodiment, the switching control means of the present invention is not limited to it and a microcomputer may be used to control in software.

Also, the first actuator and the second actuator in the present invention are comprised of a revolving motor for revolving the upper rotating body and a boom swing cylinder for swinging the boom left and right around the vertical axis, respectively, in the above embodiment. In addition, the first actuator may be the revolving motor and the second actuator may be an offset cylinder for offsetting the boom in machine-width direction.

In this case, when the revolving operation and the boom swing operation are carried out by means of only one control lever, the revolving operation of the upper rotating body can be carried out during the control member is not operated. Also, only when operation of the control member is carried out, the boom swing operation can be carried out. Even when operation of the control member is released during the boom swing operation, the boom swing operation can be continued as long as the control lever is not restored to the neutral position. As a result, a trouble that the upper rotating body is revolved rapidly by means of wrong operation can be prevented.

In brief, if it is combination of actuators without combined operation, for example, any lever operation in standard operating mode prescribed with ISO and lever operation of option apparatus can be combined.

As described above, although one embodiment of the present invention is disclosed, the scope of the protection of the present invention is not limited to it.

We claim:

1. A control circuit for a construction machine, comprising:

a control lever for carrying out operations of a first actuator and a second actuator in common;

a switching valve for supplying pilot pressure output from a remote control valve by means of operation of said control lever to a control port in any one of the first and the second actuators;

a control member for supplying a switching signal to said switching valve;

a detector for detecting whether the pilot pressure is output from said remote control valve or not; and a switching controller for switching a change-over position in said switching valve from the first actuator to the second actuator when the switching signal is output from said control member and holding said position at the second actuator when output of the pilot pressure is detected by said detector.

2. The control circuit according to claim 1, further comprising a relay provided between said control member and said switching valve, the relay being self-held with signal output from said detector.

3. The control circuit according to claim 1, wherein said first actuator is a revolving motor for rotating an upper rotating body and said second actuator is a boom swing cylinder for swinging a boom left and right around a vertical axis or an offset cylinder for offsetting the boom in a machine-width direction.

4. The control circuit according to claim 1, wherein said detector includes a pressure switch provided in a pilot line passing from said remote control valve to said switching valve.

* * * * *